US010327972B2

(12) United States Patent
Cella

(10) Patent No.: US 10,327,972 B2
(45) Date of Patent: Jun. 25, 2019

(54) PORTABLE MASSAGE TABLE

(71) Applicant: Timothy Bryan Cella, Layton, UT (US)

(72) Inventor: Timothy Bryan Cella, Layton, UT (US)

( * ) Notice: Subject to any disclaimer, the term of this patent is extended or adjusted under 35 U.S.C. 154(b) by 357 days.

(21) Appl. No.: 15/202,508

(22) Filed: Jul. 5, 2016

(65) Prior Publication Data

US 2017/0000674 A1 Jan. 5, 2017

Related U.S. Application Data

(60) Provisional application No. 62/188,471, filed on Jul. 2, 2015.

(51) Int. Cl.

| | |
|---|---|
| ***A61G 13/00*** | (2006.01) |
| ***A61G 13/10*** | (2006.01) |
| ***A47C 20/02*** | (2006.01) |
| ***A61G 13/12*** | (2006.01) |

(52) U.S. Cl.

CPC ..... *A61G 13/105* (2013.01); *A47C 20/026* (2013.01); *A61G 13/009* (2013.01); *A61G 13/121* (2013.01)

(58) Field of Classification Search

CPC ..... A47C 20/00; A47C 20/02; A47C 20/026; A47C 20/04; A47C 20/042; A47C 20/043; A47C 20/06; A47C 21/00; A61G 13/009; A61G 13/105; A61G 13/121; A61G 13/122; A61G 13/129; A61H 2205/02; A61H 2205/022; A61H 2205/08; A61H 2205/084; A61H 37/00

See application file for complete search history.

(56) References Cited

U.S. PATENT DOCUMENTS

| | | | | |
|---|---|---|---|---|
| 3,738,705 A * | 6/1973 | Hill | A47C 17/162 297/354.13 |
| 5,401,078 A * | 3/1995 | Riach | A47C 7/503 297/19 |
| 5,971,485 A * | 10/1999 | Clark | A61G 13/009 297/195.11 |
| 6,148,460 A * | 11/2000 | Fried | A61G 13/009 5/622 |
| 6,151,734 A * | 11/2000 | Lawrie | A47C 20/026 5/622 |
| 6,397,414 B1 * | 6/2002 | Lloyd | A47C 20/026 297/900 |

(Continued)

*Primary Examiner* — Robert G Santos
*Assistant Examiner* — David R Hare
(74) *Attorney, Agent, or Firm* — Christopher Pilling

(57) ABSTRACT

In one embodiment of the present invention a portable massage table is provided, comprising a chest support element having a top side and a bottom side; a chest cushion affixed to the top side of chest support element; a pair of hinge support elements attached to bottom side of chest support element; a pair of support legs rotational mounted to the pair of hinge support elements, wherein the pair of support legs comprise a plurality of positional holes; a pair of head support beams rotational mounted to the pair of hinge support elements, wherein the pair of head support beams are designed to support a face cushion; and a base plate removable attached to the plurality of positional holes via removable hardware.

9 Claims, 8 Drawing Sheets

(56) References Cited

U.S. PATENT DOCUMENTS

| | | | | |
|---|---|---|---|---|
| 6,718,581 | B2 * | 4/2004 | Riach | A61B 6/0421 5/607 |
| 7,036,168 | B1 * | 5/2006 | Knickerbocker | A47G 9/10 5/636 |
| 8,370,976 | B2 * | 2/2013 | Matt | A47C 20/026 5/638 |
| D683,463 | S * | 5/2013 | Huggins | A47C 16/00 D24/184 |
| 2002/0100846 | A1 * | 8/2002 | Tinsley | A61G 13/12 248/118 |
| 2003/0084513 | A1 * | 5/2003 | Splane, Jr. | A47C 20/026 5/657 |
| 2007/0270683 | A1 * | 11/2007 | Meloy | A61B 5/0555 600/415 |
| 2009/0222986 | A1 * | 9/2009 | Hamilton | A47C 31/10 5/488 |
| 2011/0047705 | A1 * | 3/2011 | Gorovitz | A61G 13/009 5/613 |
| 2013/0232696 | A1 * | 9/2013 | Halimi | A47C 16/00 5/640 |
| 2014/0150183 | A1 * | 6/2014 | Westra | A61G 13/105 5/617 |
| 2015/0001905 | A1 * | 1/2015 | Jackow | A47C 7/383 297/397 |
| 2016/0081482 | A1 * | 3/2016 | Schumacher | A47C 7/383 5/640 |
| 2016/0151221 | A1 * | 6/2016 | Mount | A47C 7/38 5/638 |
| 2017/0265640 | A1 * | 9/2017 | Du | A47B 3/087 |

* cited by examiner

PORTABLE MASSAGE TABLE

CROSS-REFERENCE TO RELATED APPLICATIONS

The present application claims priority to U.S. Provisional Patent Application Ser. No. 62/188,471, filed on Jul. 2, 2015 entitled "Mini Massage Table", the disclosure of which is hereby incorporated in its entirety at least by reference.

BACKGROUND OF THE INVENTION

1. Field of the Invention

The present invention relates to massage tables, and more particularly a portable massage table.

2. Description of Related Art

Currently, massage tables are often bulky and difficult to transport to one location to another. Likewise, massage tables take up a lot of space when not in use. Furthermore, when performing a massage on a person without a table, such as on a bed or a floor it is often uncomfortable for the person receiving the massage. Consequently, there is a need for a massage table that provides the benefits of a massage table while being portable and occupying minimal space when stowed.

BRIEF SUMMARY OF THE INVENTION

In one embodiment of the present invention a portable massage table is provided, comprising a chest support element having a top side and a bottom side; a chest cushion affixed to the top side of chest support element; a pair of hinge support elements attached to bottom side of chest support element; a pair of support legs rotational mounted to the pair of hinge support elements, wherein the pair of support legs comprise a plurality of positional holes; a pair of head support beams rotational mounted to the pair of hinge support elements, wherein the pair of head support beams are designed to support a face cushion; and a base plate removable attached to the plurality of positional holes via removable hardware.

In one embodiment, the base plate is designed to be positioned between a mattress and a box-spring during use. In another embodiment, the mattress has a thickness, and the base plate is removable attached to a pair of the plurality of positional holes determined by the thickness.

In one embodiment, the pair of head support beams is set in position by a pair of dowel pins, wherein the position is either perpendicular to the chest support element or 10 degrees inclined. In another embodiment, the pair of support legs and the pair of head support beams may be rotated to a stowed position, wherein the stowed position is defined as the base plate being removed, and the pair of support legs and the pair of head support beams rotated in parallel, adjacent to the chest support element.

In one embodiment, the base plate be positioned between the pair of support legs and the pair of head support beams and the chest support element in the stowed position. In another embodiment, the pair of support legs may be stowed position, wherein the stowed position is defined as the base plate being removed and the pair of support legs rotated in parallel, adjacent to the chest support element. In yet another embodiment, the portable massage table may be used on the floor when the pair of head support beams is set in position by a pair of dowel pins, wherein the position is either perpendicular to the chest support element or 10 degrees inclined.

In one embodiment, the face cushion has a circular shape having a central opening which conforms to a person's face during use, wherein the face cushion further comprises a pair of pockets designed to receive the pair of head support beams during use. In another embodiment, face cushion is constructed from a plush fabric and filled with a polyester fiberfill. In yet another embodiment, the chest cushion is constructed from vinyl filled with foam and batting providing a comfortable support for a person's chest during use.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a portable massage table.

Figure 1A:
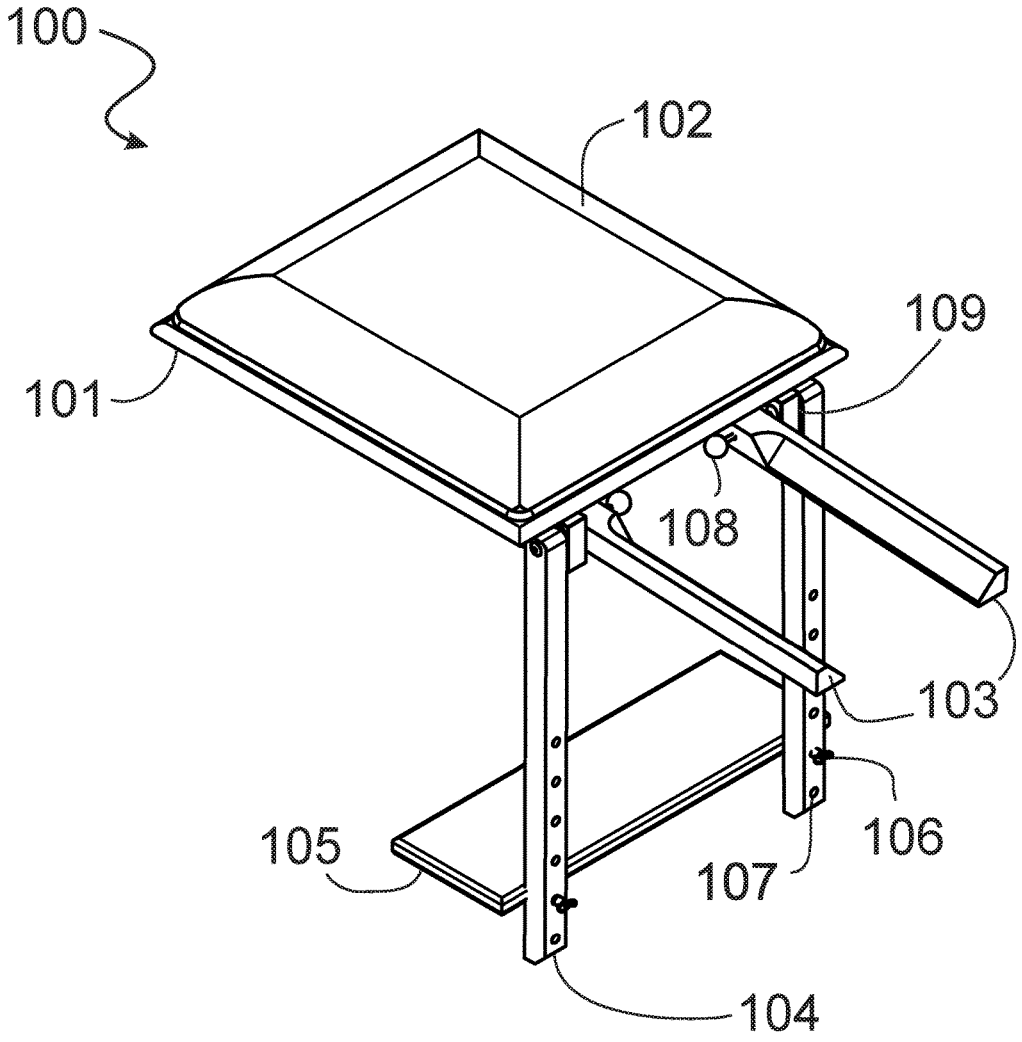
FIGS. 1A-B are perspective views of a portable massage table in an open position according to an embodiment of the present invention.
Figure 1B:
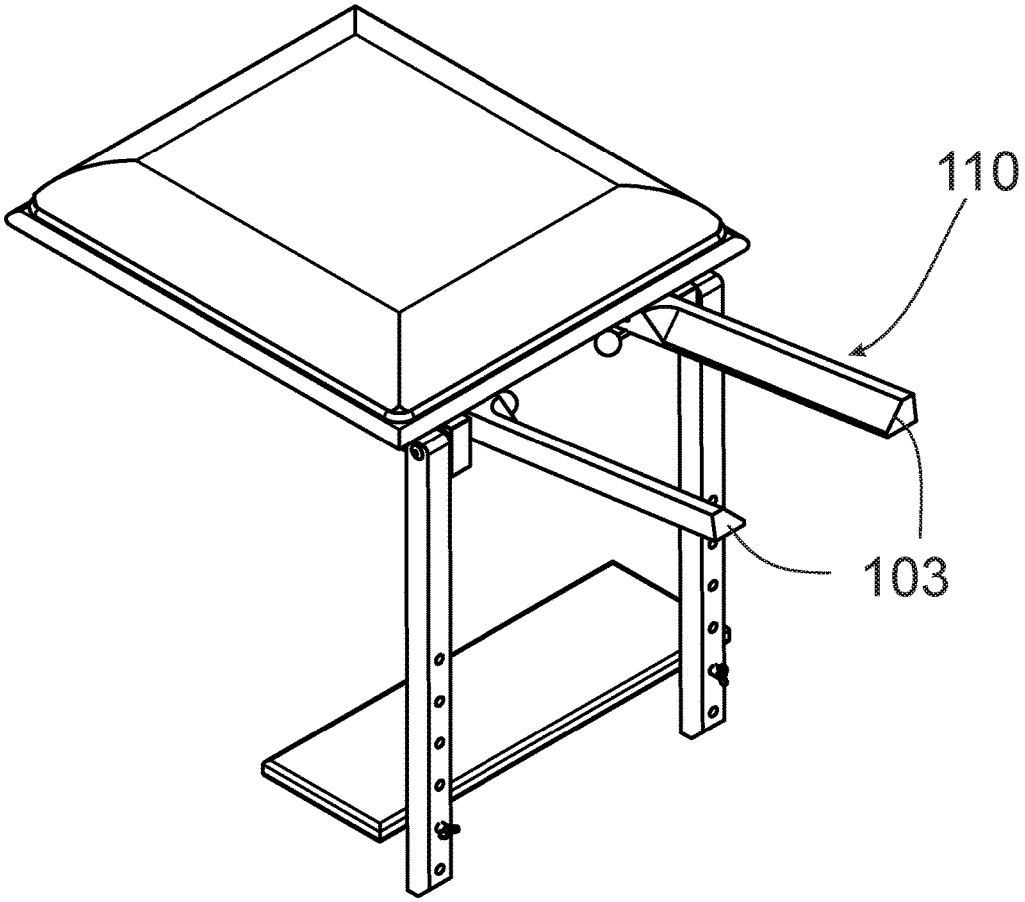

FIGS. 1A-B are perspective views of a portable massage table 100 in an open position according to an embodiment of the present invention. The portable massage table comprises a chest support element 101 having a chest cushion 102 constructed from vinyl, wherein the vinyl is filled with foam and batting providing a comfortable support for a person's chest during use. The portable massage table further comprises a pair of head support beams 103 design to hold a face cushion (FIG. 5), a pair of support legs 104, and a base plate 105. The base plate is affixed to the pair of support legs via bolts and wing nuts 106 through a plurality of positional holes 107. The selected positional hole is determined by the thickness of a mattress the portable massage table is intended to be installed on during use. This will be explained in further detail below. A pair of dowel pins 108 is used to hold the pair of head support beams in position. In some embodiments, two position settings are available including 0 degree or perpendicular, and 10 degrees inclined. FIG. 1A illustrates the pair of head support beams in the perpendicular position. FIG. 1B illustrates the pair of head support beams in a 10 degree inclined position 110. The portable massage table further comprises a hinge support element 109 attached to the chest support element providing a location for connection and support to the pair of support legs and the pair of head support beams. The hinge support element further supports the pair of support legs and the pair of head support beams during rotation. It is understood that two identical hinge support elements are provided for each of the pair of support legs and head support beams.

Figure 2A:
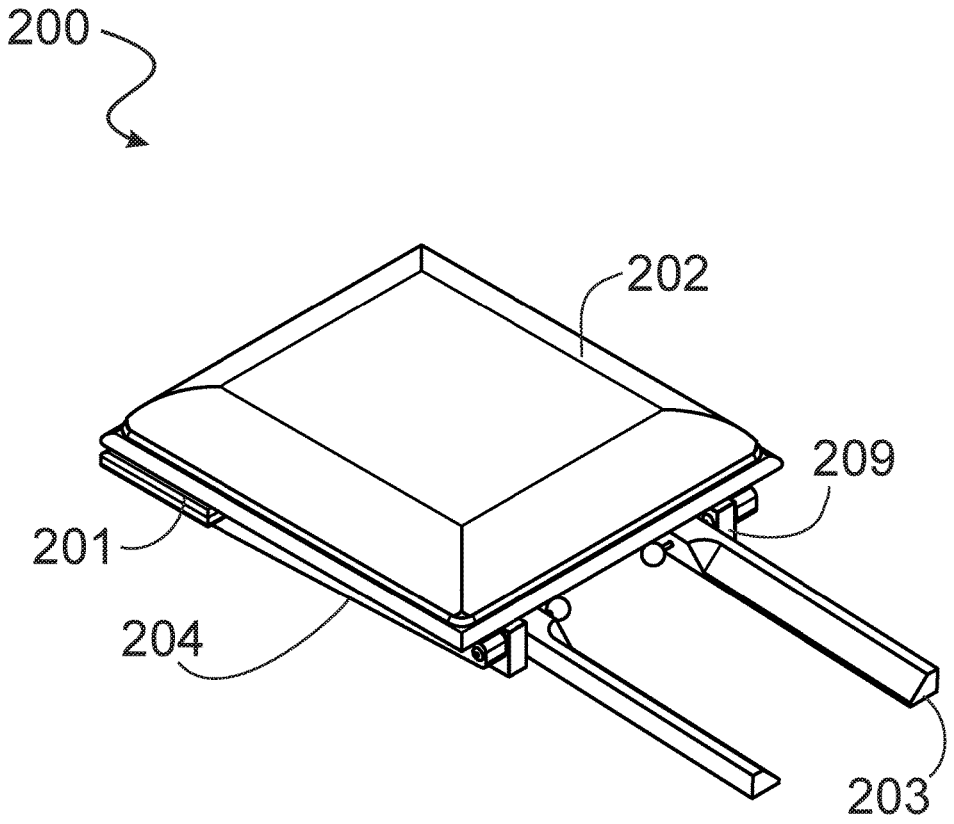
FIGS. 2A-B are perspective views of a portable massage table in a partially open position according to an embodiment of the present invention.
Figure 2B:
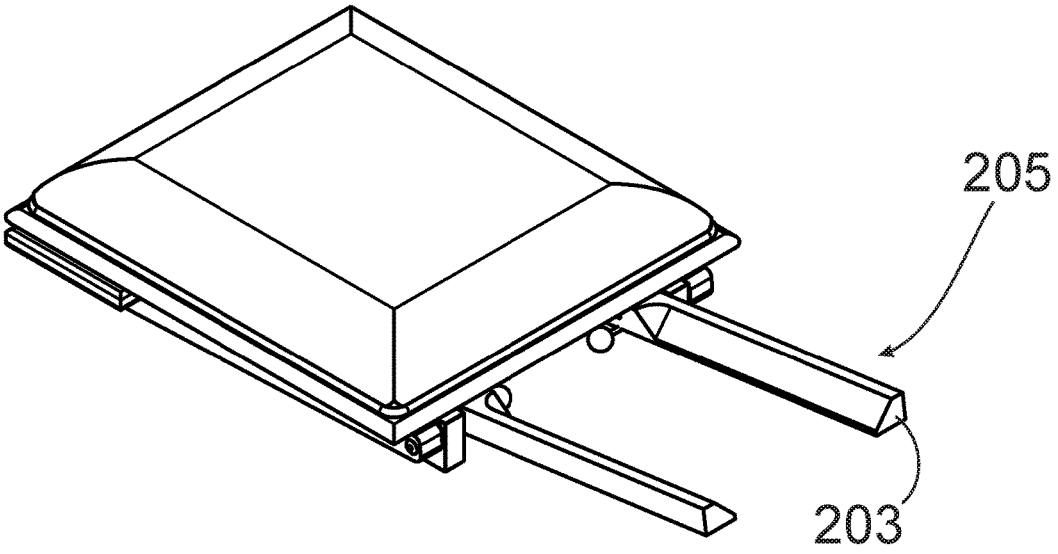
Figure 5:
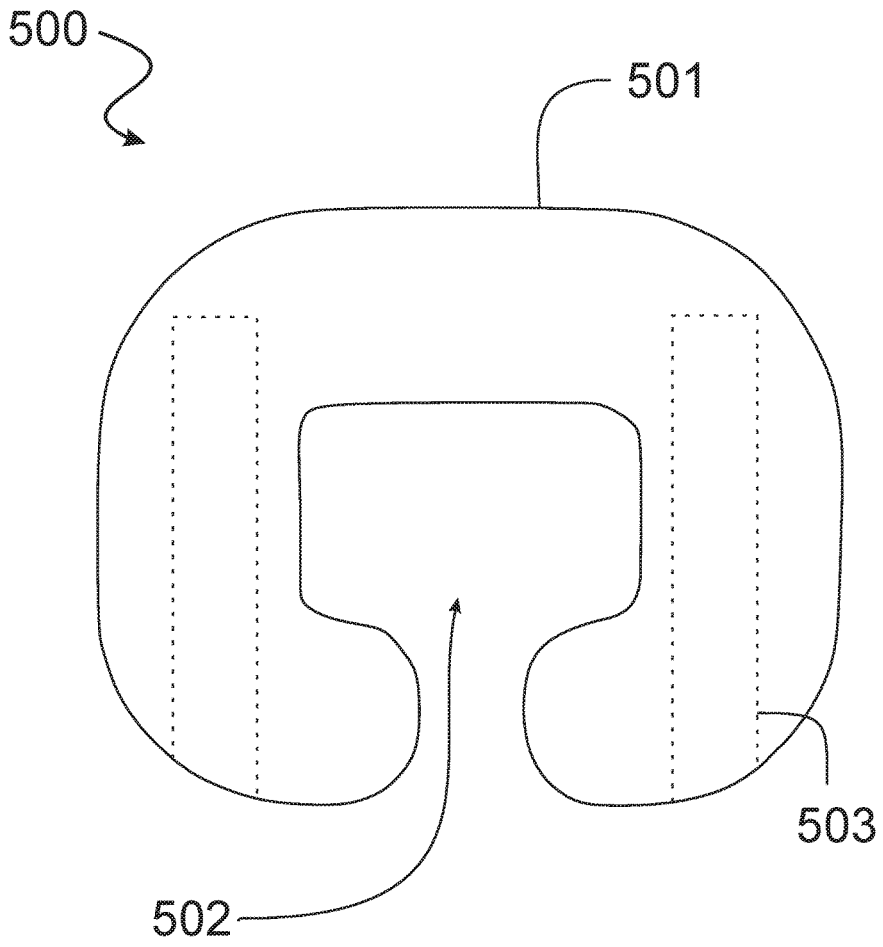
FIG. 5 is a bottom view of a face cushion according to an embodiment of the present invention.

FIGS. 2A-B are perspective views of a portable massage table 200 in a partially open position according to an embodiment of the present invention. The portable massage table comprises a chest support element 201 having a chest cushion 202, a pair of head support beams 203, a hinge support element 209, and a pair of support legs 204 which are stowed in the exemplary embodiment. The pair of head support beams is design to hold a face cushion (FIG. 5). It is a particular advantage of the present invention to be used directly on the floor as opposed to the bed as previously mentioned. FIGS. 2A-B illustrate the portable massage table positioned to be used on the floor. In some embodiments, two position settings are available including 0 degree or perpendicular, and 10 degrees inclined. FIG. 2A illustrates the pair of head support beams in the perpendicular position. FIG. 2B illustrates the pair of head support beams in a 10 degree inclined position 205.

Figure 3A:
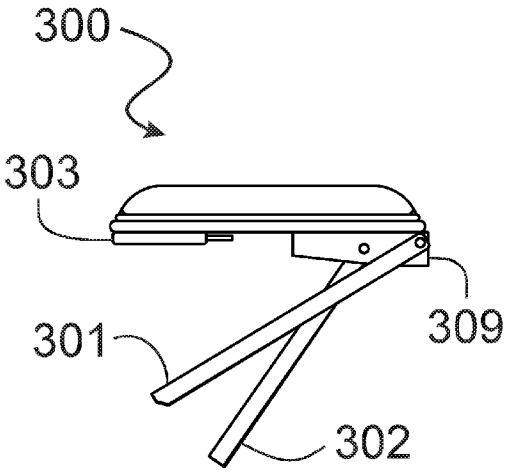
FIGS. 3A-D are side views of a portable massage table in various positions according to an embodiment of the present invention.
Figure 3B:
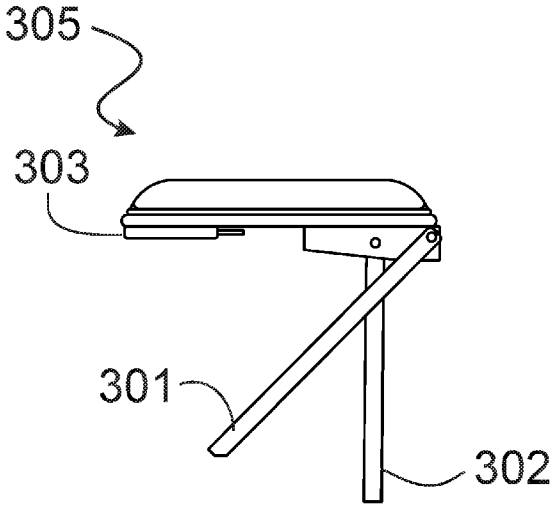
Figure 3C:
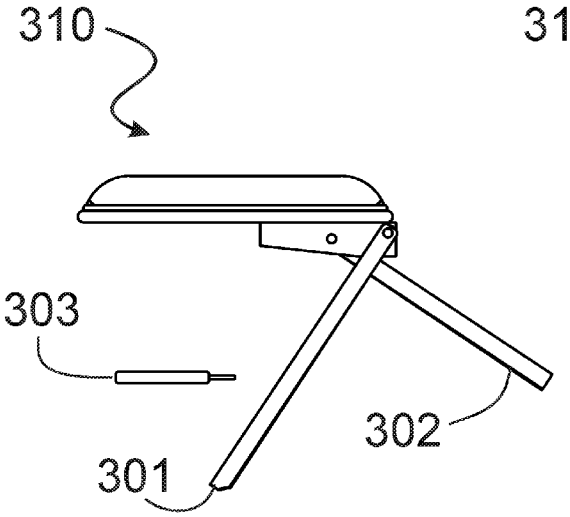
Figure 3D:
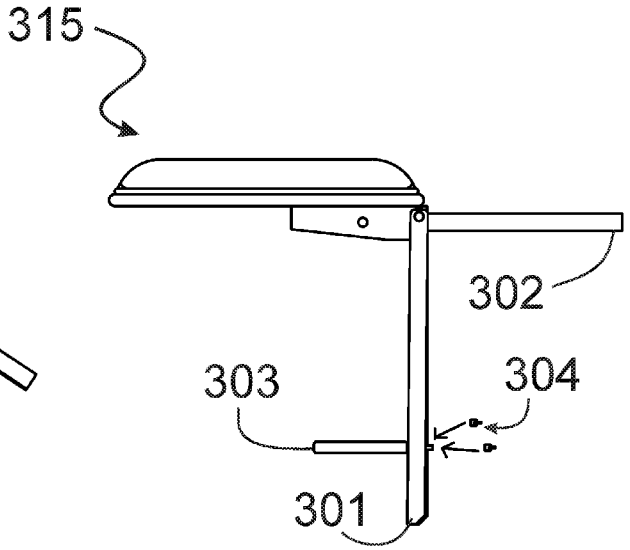

FIGS. 3A-D are side views of a portable massage table in various positions according to an embodiment of the present invention. The portable massage table comprises a pair of support legs 301, a pair of head support beams 302, a base plate 303. The pair of support legs and the pair of head support beams are supported by a hinge support element 309. In FIG. 3A, the portable massage table is in a partially open position 300, wherein the pair of support legs and the pair of head support beams are in rotation from a stowed position. FIG. 3B illustrates the portable massage table in a partially open position 305, wherein the pair of support legs and the pair of head support beams are further rotated about the hinge support element. Likewise, in FIG. 3C the portable massage table is in a partially open position 310, wherein the pair of support legs and the pair of head support beams are further rotated about the hinge support element and the base plate is removed from its stowed location. Finally, in FIG. 3D the portable massage table is in an open position 315, wherein the pair of support legs and the pair of head support beams are in a fully open positioned, and the base plate is affixed to the pair of support legs via removable mounting hardware 304. In the open position as illustrated, the portable massage table is ready for use on a bed.

Figure 4:
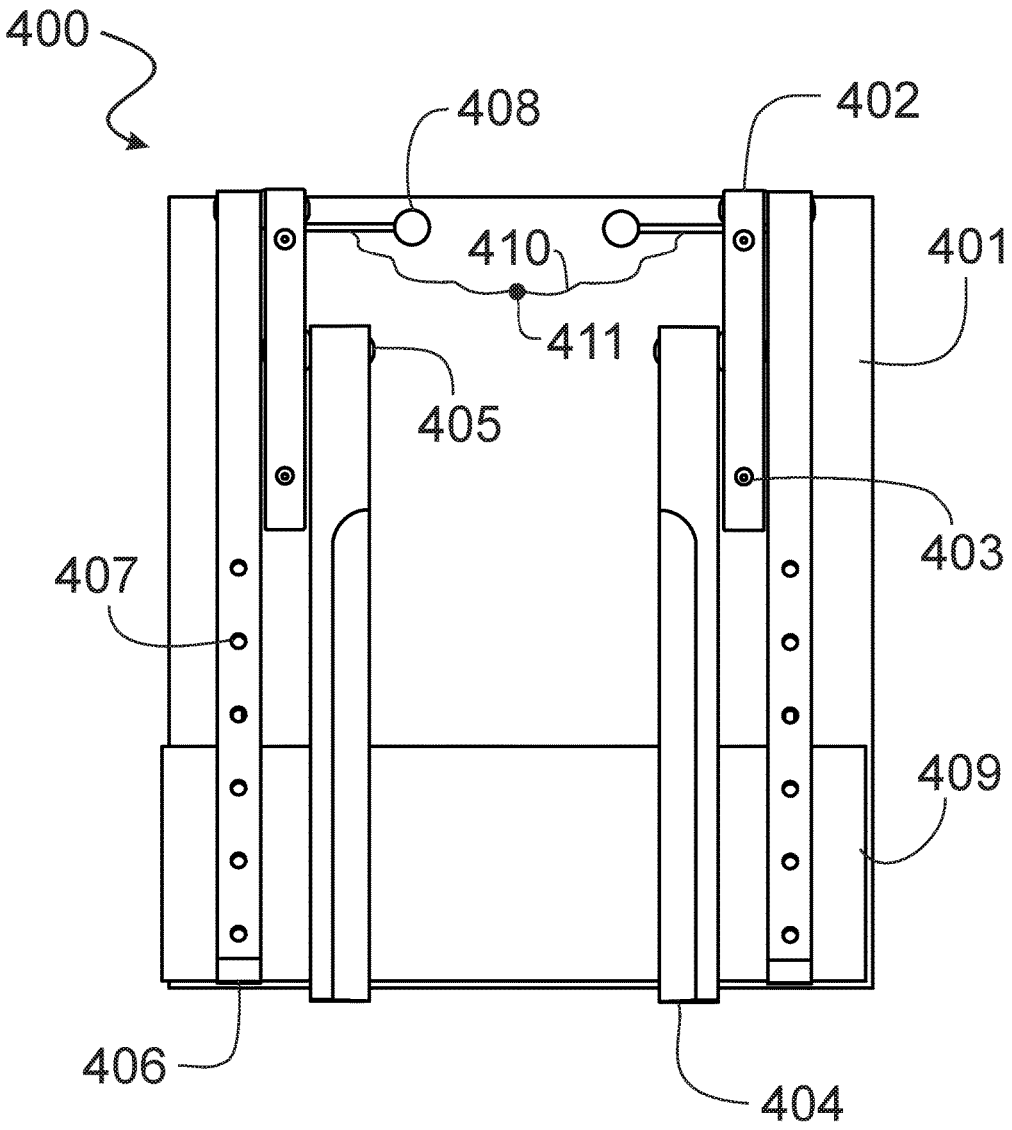
FIG. 4 is a bottom view of a portable massage table in a stowed position according to an embodiment of the present invention.

FIG. 4 is a bottom view of a portable massage table 400 in a stowed position according to an embodiment of the present invention. The portable massage table comprises a chest support element 401 and a hinge support element 402. The hinge support element is mounted to the chest support element via mounting hardware 403, which can be any mounting hardware known in the art. The portable massage table further comprises a pair of head support beams 404 rotational mounted to the hinge support element via mounting pin 405. The portable massage table further comprises a pair of support legs 406 having a plurality of positional holes 407, and a base plate 409. As previously mentioned the base plate is affixed to the pair of support legs via the plurality of positional holes during use. A pair of dowel pins 408 is used to affix the pair of head support beams in position during use, wherein the pair of dowel pins is attached to the chest support element via hardware 411 and lanyards 410.

As illustrated, the portable massage table occupies little space when in the stowed position allowing a person to bring the portable massage table to any location desired while taking up less space when not in use. It is particular advantage of the present invention to fit inside shoulder bag similarly to a bag used to carry a laptop computer. Likewise, the plurality of positional holes of the pair of support legs allow the portable massage table to be installed on virtually any sized mattress. In some embodiments, the portable massage table may be installed on mattress up to 18 inches thick.

FIG. 5 is a bottom view of a face cushion 500 according to an embodiment of the present invention. The face cushion has a circular shape 501 having a central opening 502 which conforms to a person's face during use. The face cushion further comprises a pair of pockets 503 designed to receive the pair of head support beams during use. In some embodiments, the face cushion is constructed from a plush fabric, such as minky, and filled with a polyester fiberfill, such as Poly-Fil. The materials selected are designed for maximum support and comfort during use.

Figure 6:
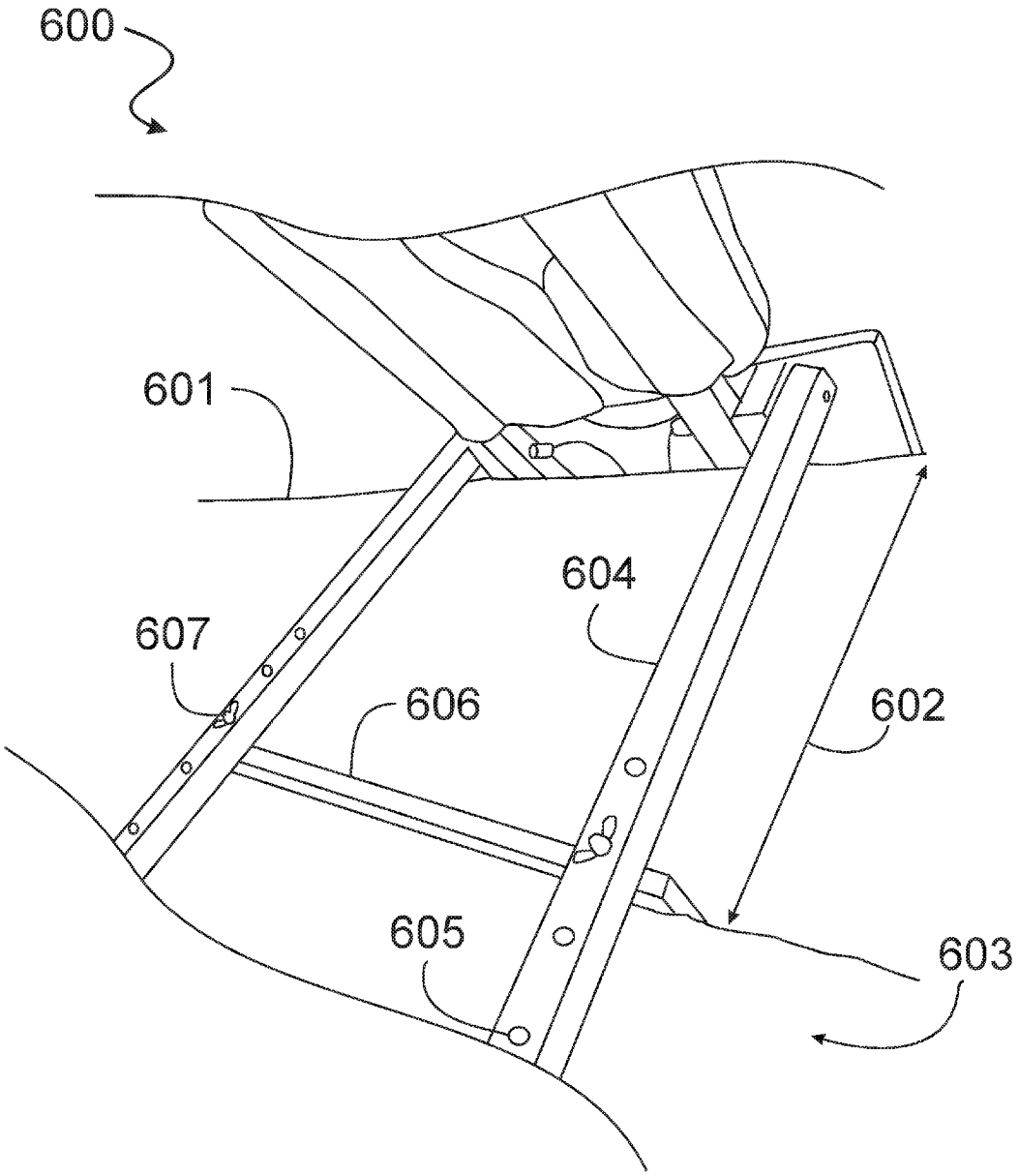
FIG. 6 is a perspective view of a portable massage table installed on a bed for use according to an embodiment of the present invention.

FIG. 6 is a perspective view of a portable massage table 600 installed on a bed for use according to an embodiment of the present invention. Referring now to FIG. 6, the portable massage table is installed on the bed comprising a mattress 601 having a thickness 602. The mattress is positioned on a box-spring 603 as well known in the art. As previously mentioned, the portable massage table comprises a pair of support legs 604 having a plurality of positional holes 605, and base plate 606. The base plate is affixed to a specific pair of positional holes of the plurality of positional holes depending on the thickness of the mattress via removable mounting hardware 607. In some embodiments, the distance between the plurality of positional holes is one inch, and the plurality of positional holes are equally spaced. However, it is understood that the spacing and distance of the plurality of positional holes may be modified without departing from the scope of the invention. In some embodiments, for best results, the specific pair of positional holes selected should correspond to one or two inches less than the thickness of the mattress. This selected position, allows the mattress to support the body weight of the user, while allowing the portable massage table to support the chest, neck and head of the user. The base plate is positioned between the mattress and box spring as illustrated.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

What is claimed is:

1. A portable massage table comprising:

a chest support element having a top side and a bottom side;

a chest cushion affixed to the top side of chest support element;

a pair of hinge support elements attached to the bottom side of the chest support element;

a pair of support legs rotationally mounted to the pair of hinge support elements, wherein the pair of support legs comprises a plurality of positional holes;

a pair of head support beams rotational mounted to the pair of hinge support elements, wherein the pair of head support beams are designed to support a face cushion;

a base plate removably attached to the plurality of positional holes via removable hardware, wherein the pair of support legs and the pair of head support beams are configured to be rotated to a stowed position, wherein the stowed position is defined as the base plate being removed, and the pair of support legs and the pair of head support beams rotated in parallel relative to the chest support element, and the base plate is configured to be positioned between the pair of support legs and the pair of head support beams and the chest support element in the stowed position.

2. The portable massage table of claim 1, wherein the base plate is configured to be positioned between a mattress and a box-spring during use.

3. The portable massage table of claim 2, wherein the mattress has a thickness, and the base plate is removably attached to a pair of the plurality of positional holes determined by the thickness.

4. The portable massage table of claim 1, wherein the pair of head support beams is set in position by a pair of dowel pins, wherein the position is selected via the rotation of the pair of hinge support elements and is either perpendicular to the chest support element or 10 degrees inclined relative from the chest support element.

5. The portable massage table of claim 1, wherein the pair of support legs is configured to be placed into a stowed position, wherein the stowed position is defined as the base plate being removed and the pair of support legs rotated in parallel relative to the chest support element.

6. The portable massage table of claim 5, wherein the portable massage table is configured to be used on the floor when the pair of head support beams is set in position by a pair of dowel pins, wherein the position is either perpendicular to the chest support element or 10 degrees inclined relative from the chest support element.

7. The portable massage table of claim 1, wherein the face cushion has a circular shape having a central opening which conforms to a person's face during use, wherein the face cushion further comprises a pair of pockets designed to receive the pair of head support beams during use.

8. The portable massage table of claim 7, wherein the face cushion is constructed from a soft fabric and filled with a polyester fiberfill.

9. The portable massage table of claim 1, wherein the chest cushion is constructed from vinyl filled with foam and batting providing a comfortable support for a person's chest during use.

* * * * *